US009721735B2

(12) United States Patent
Hsu et al.

(10) Patent No.: US 9,721,735 B2
(45) Date of Patent: Aug. 1, 2017

(54) MULTI-FUNCTION CHARGER

(71) Applicant: POWERTECH INDUSTRIAL CO., LTD., New Taipei (TW)

(72) Inventors: Jung-Hui Hsu, New Taipei (TW); Fan-Keng Ho, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 14/986,837

(22) Filed: Jan. 4, 2016

(65) Prior Publication Data

US 2016/0197431 A1 Jul. 7, 2016

(30) Foreign Application Priority Data

Jan. 5, 2015 (TW) ..... 104100076 A

(51) Int. Cl.

| | |
|---|---|
| ***H01R 13/44*** | (2006.01) |
| ***H01H 13/14*** | (2006.01) |
| ***H01R 24/30*** | (2011.01) |
| ***H01R 27/00*** | (2006.01) |
| ***H01R 31/06*** | (2006.01) |
| *H01R 103/00* | (2006.01) |

(52) U.S. Cl.

CPC ..... *H01H 13/14* (2013.01); *H01R 24/30* (2013.01); *H01R 27/00* (2013.01); *H01R 31/065* (2013.01); *H01R 2103/00* (2013.01)

(58) Field of Classification Search

CPC ..... H01R 13/44; H01R 13/4538
USPC ..... 439/131, 172
See application file for complete search history.

(56) References Cited

U.S. PATENT DOCUMENTS

| | | | | |
|---|---|---|---|---|
| 6,939,150 | B1 | 9/2005 | Lanni | |
| 7,035,126 | B1 * | 4/2006 | Lanni | H01R 31/065 363/142 |
| 7,604,492 | B1 | 10/2009 | Wang | |
| 7,938,653 | B2 | 5/2011 | Hopwood et al. | |
| 9,331,441 | B2 * | 5/2016 | Roy | H01R 13/434 |

* cited by examiner

*Primary Examiner* — Phuong Dinh
(74) *Attorney, Agent, or Firm* — Li & Cai Intellectual Property (USA) Office

(57) ABSTRACT

A multi-function charger is provided. The multi-function charger includes a main body, a first plug, a first base, a second base, and a linkage element. The main body has a first surface having a recess and a second surface opposite thereto. The first plug having a first connector, a second connector, and a third connector is arranged in the main body and exposed on the first surface. The first base is connected to the first and second connectors, and the second base is connected to the third connector. The linkage element is pivotally connected to the first and second bases so that the first connector, the second connector, and the third connector are capable of rotating in the same direction until to be arranged in the recess. The linkage element is located in a connecting region defined between the central section of the first base and the second base.

10 Claims, 11 Drawing Sheets

MULTI-FUNCTION CHARGER

BACKGROUND

1. Technical Field

The present disclosure relates to a multi-function charger, in particular, to a portable multi-function charger.

2. Description of Related Art

Mobile devices generally employ rechargeable batteries. However, the connectors of the plugs are inconvenient for storage. U.S. Pat. No. 6,939,150 provides a foldable electrical plug connector which utilizes the movement of gear components to arrange the pins in a recess of the housing.

U.S. Pat. No. 7,604,492 provides a power supply adapter that arranges the connector components in the base frame by a driver module.

The plug connectors or chargers provided by the above patents are only designed based on one type of electrical specification. Therefore, a user has to further employ a converter according to the electrical specification in different countries if he is abroad which is very inconvenient.

SUMMARY

In view of the above problem, the embodiment of the instant disclosure provides a multi-function charger having a plurality of plug components with different electrical specifications and a plurality of sets of socket slots for selection, and the plug of the multi-function charger may be arranged in the main body of the multi-function charger by a linkage element, thereby enabling the user to store the multi-function charger.

An exemplary embodiment of the present disclosure provides a multi-function charger comprising a main body, a first plug, a first base, a second base and a linkage element. The main body has a first surface and a second surface opposite to the first surface, and the first surface has a recess. The first plug is arranged on the first surface and has a first connector, a second connector and a third connector. The first base connects to the first connector and the second connector, and the second base connects to the third connector. The linkage element pivotally connects to the first base and the second base, and the first connector, the second connector and the third connector rotate in a same direction to be arranged in the recess. The linkage element is located in a connecting region defined between the central section of the first base and the second base.

The advantage of the instant disclosure resides in that the plug and charger in conformance with different electrical specifications are provided. The plug of the multi-function charger has a plurality of connectors, and when the first connector, the second connector or the third connector are moved by means of the linkage element, the first connector, the second connector and the third connector will rotate toward the same direction relative to the main body to a horizontal position for being folded and arranged in the recess, thereby enabling the user to carry and store the multi-function charger.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the present disclosure.

DESCRIPTION OF THE EXEMPLARY EMBODIMENTS

Figure 1A:
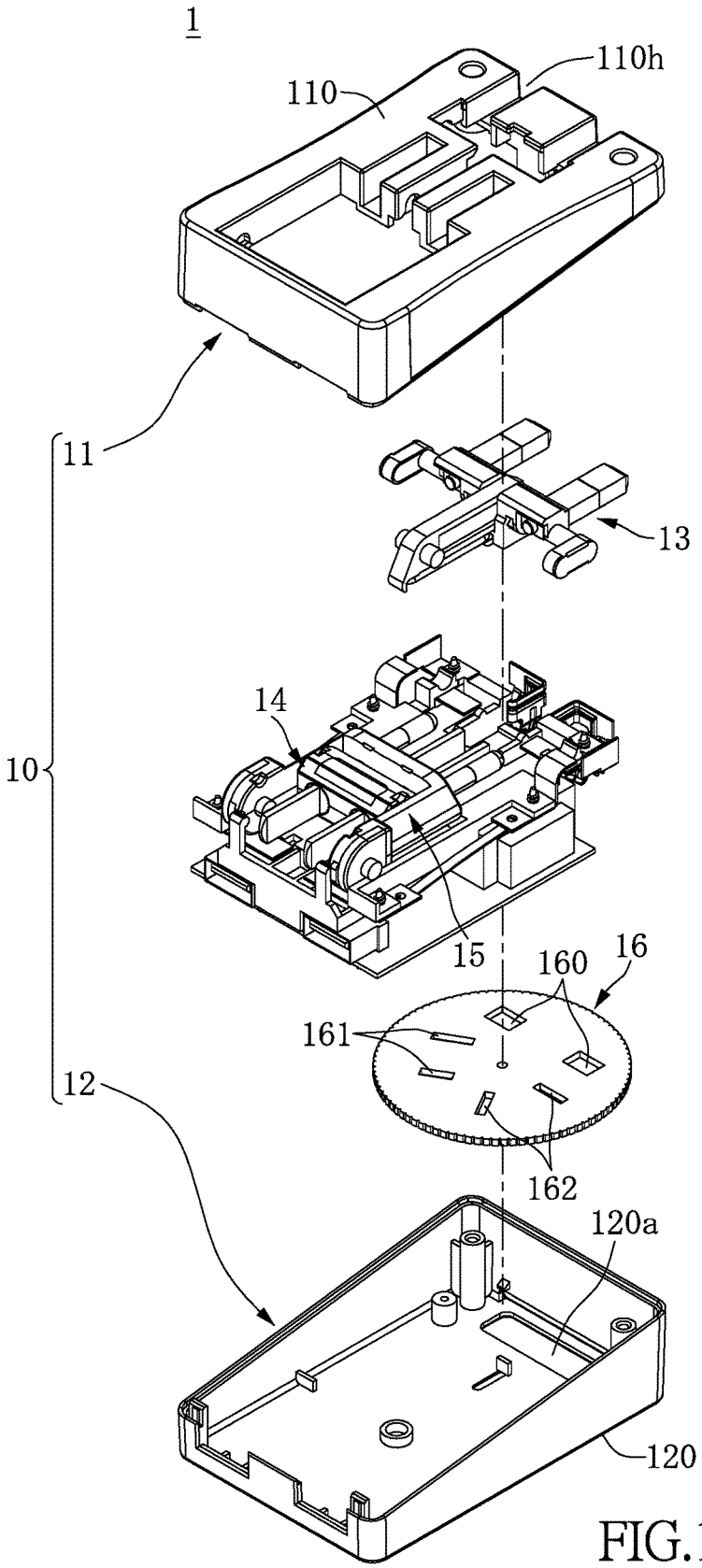
FIG. 1A is a 3-dimentional exploded view of a multi-function charger of an embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

Figure 1B:
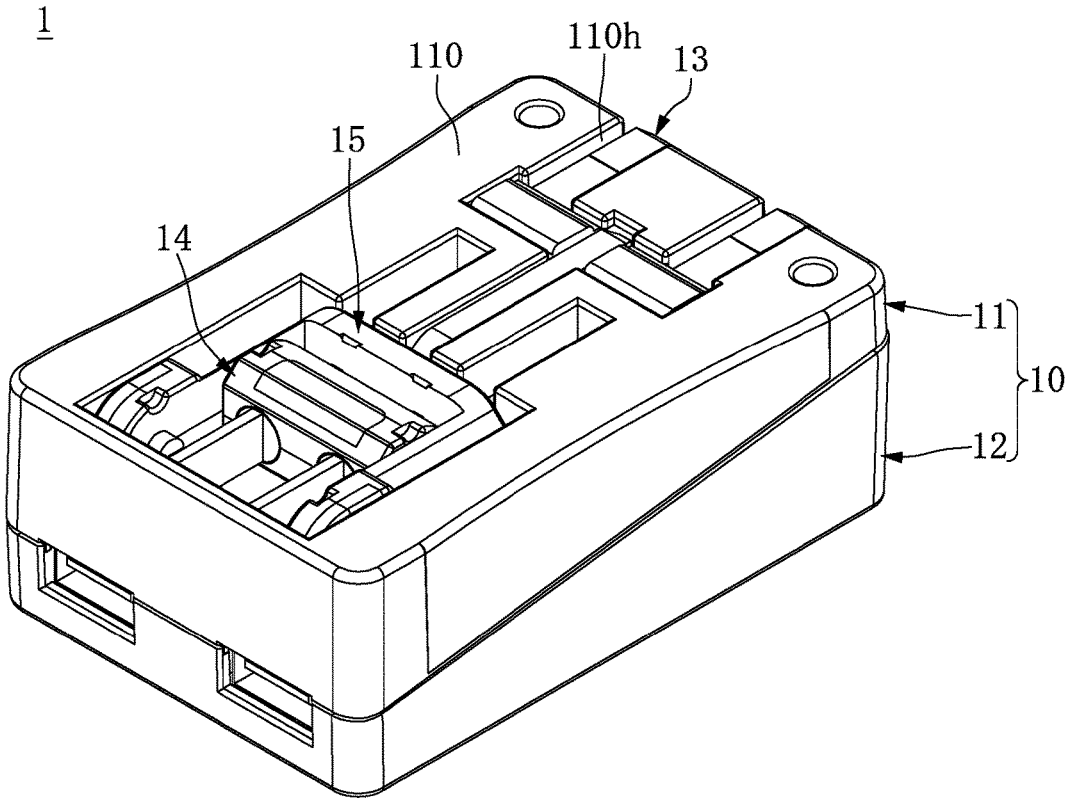
FIG. 1B is a 3-dimentional view of the multi-function charger of the embodiment of the instant disclosure.

Please refer to FIG. 1A and FIG. 1B. FIG. 1A is a 3-dimentional exploded view of a multi-function charger of an embodiment of the instant disclosure. FIG. 1B is a 3-dimentional view of the multi-function charger of the embodiment of the instant disclosure. The multi-function charger 1 comprises a main body 10, and the main body 10 comprises a first casing 11 and a second casing 12, wherein the first casing 11 and the second casing 12 form an accommodating space for arranging the plurality of plug components 13~15 and a socket slot selecting member 16.

In addition, the main body 10 has a first surface 110 and a second surface 120 opposite to the first surface 110, wherein the first surface 110 is located on the first casing 11 and the second surface 120 is located on the second casing 12. The first surface 110 has a plurality of recesses 110*h* for arranging different plug components 13~15. The second surface 120 has a socket region 120*a* to expose the socket slot selecting member 16. The arrangement of the socket region 120*a* and the socket slot selecting member 16 will be described in detail below.

The plurality of plug components 13~15 are arranged in the main body 10, and are exposed from the first surface 110 of the main body through the recesses 110*h*. The plug components 13~15 are designed based on the electrical specifications of different countries, such as United Kingdom, United States or Australia.

Figure 2A:
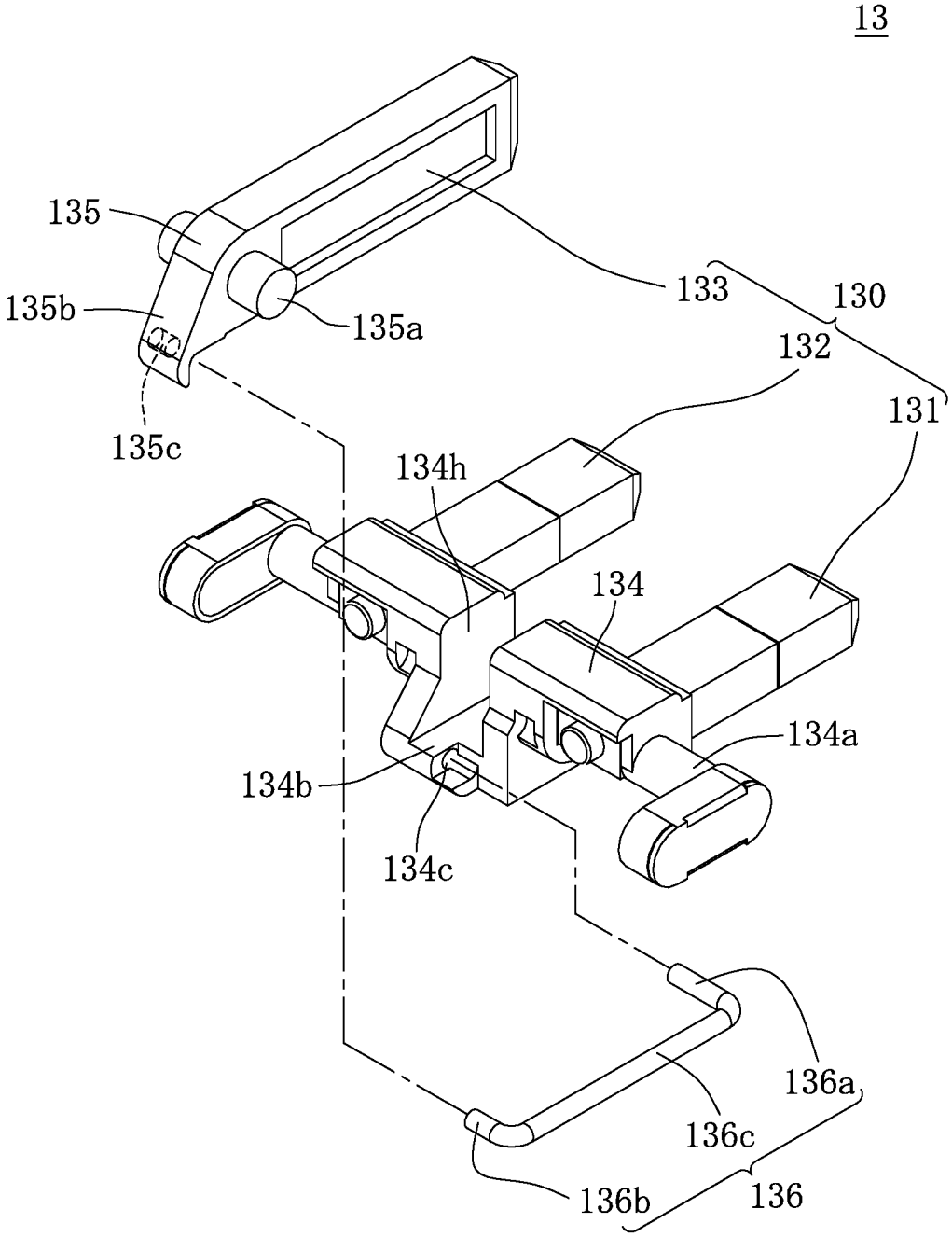
FIG. 2A is an exploded view of a plug component of the embodiment of the instant disclosure.
Figure 2B:
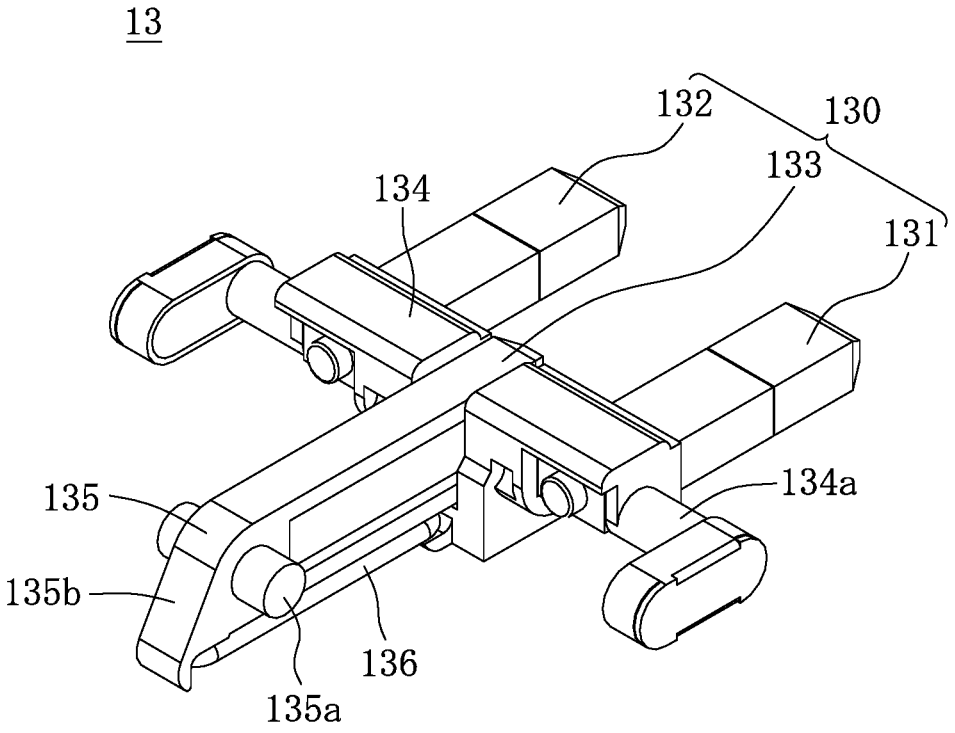
FIG. 2B is a 3-dimentional view of the plug component of the embodiment of the instant disclosure.

Please refer to FIG. 2A and FIG. 2B. FIG. 2A is an exploded view of plug components of an embodiment of the instant disclosure. FIG. 2B is a 3-dimentional view of plug components of an embodiment of the instant disclosure. The plug component 13 comprises a first plug 130, a first base 134, a second base 135 and a linkage element 136.

The first plug 130 has a first connector, a second connector 132 and a third connector 133, wherein the first connector 131 and the second connector 132 connect to the first base 134, and the third connector 133 connects to the second base 135. In addition, the linkage element 136 is pivotally positioned between the first base 134 and the second base 135 for enabling the first connector 131, the second connector 132 and the third connector 133 to rotate toward a same direction relative to the main body 10.

When the first connector 131, the second connector 132 and the third connector 133 rotate to a horizontal position, the first connector 131, the second connector 132 and the third connector 133 may be arranged in the recesses 110*h*. When the first connector 131, the second connector 132 and the third connector 133 rotate to a vertical position, the first connector 131, the second connector 132 and the third connector 133 are protruded from the first surface 110 of the main body 10 so as to be able to be plugged with other plugs by a user. The movement of the plug component 13 is described in detail below.

In an embodiment, the first connector 131, the second connector 132, and the third connector 133 are electrically connected to the live wire, the neutral wire and the earth wire of the supply mains respectively. Furthermore, the shapes and relative distances of the first connector 131, the second connector 132 and the third connector 133 are varied according to the electrical guidelines in different countries.

In addition, the first base 134 and the second base 135 are both positioned in the main body 10. The first base 134 has a first axial portion 134*a* and a first extension portion 134*b*, wherein the first base 134 is pivotally positioned in the main body 10 through the first axial portion 134*a*, and is able to pivotally rotate relative to the main body 10 based on the first axial portion 134*a* as an axle center, thereby driving the first connector 131 and the second connector 132 to rotate.

Please refer to FIG. 2A. In the present embodiment, the first base 134 has a slot 134*h* positioned between the first connector 131 and the second connector 132. During the procedure of rotating the first connector 131, the second connector 132 and the third connector 133 from the vertical position to the horizontal position, the third connector 133 is rotated toward the first connector 131 and the second connector 132. Therefore, when the third connector 133 is rotated to the horizontal position, the slot 134*h* of the first base 134 may be used to arrange the front end of the third connector 133. However, in the other embodiments, if the third connector 133 is not rotated toward the first connector 131 and the second connector 132, is not necessary for the first base 134 to have a slot 134*h*.

The first extension portion 134*b* is connected to the first axial portion 134*a*, and the extension direction of the first extension portion 134*b* is substantially opposite to the extension direction of the first connector 131 and the second connector 132. In the present embodiment, the first extension portion 134*b* is positioned between the first connector 131 and the second connector 132, and has a first pivoting portion 134*c* for connecting the linkage element 136.

The second base 135 has the third connector 133 positioned thereon and the third connector 133 is corresponding to the slot 134*h* of the first base 134. Similar to the first base 134, the second base 135 has a second axial portion 135*a* and a second extension portion 135*b*. In addition, the second base 135 is pivotally positioned in the main body 10 through the second axial portion 135*a*, and may rotate relative to the main body 10 based on the second axial portion 135*a* as an axial center, thereby driving the third connector 133 to rotate.

Furthermore, the second extension portion 135*b* is extended from the second axial portion 135*a* toward the direction opposite from the first base 134, and has a second pivoting portion 135*c* for connecting the linkage element 136. In the present embodiment, the first pivoting portion 134*c* and the second pivoting portion 135*c* are through holes. However, in other embodiments, the first pivoting portion 134*c* and the second pivoting portion 135*c* may be concave bosses or other structures that may be used for combining the linkage element 136.

It is worthwhile to mention that in the present embodiment, the first extension portion 134*b* of the first base 134 and the second extension portion 135*b* of the second base 135 has a first gap and a second gap, and the first pivoting portion 134*c* is positioned in the first gap and the second pivoting portion 135*c* is positioned in the second gap. When the first base 134 and the second base 135 rotate, the first gap and the second gap keep the linkage element 136 from interfering with the rotation of the first base 134 and the second base 135.

The linkage element 136 connects the first base 134 with the second base 135. In the present embodiment, the linkage element 136 is positioned in a position in the area between the long axis of the first connector 131 and the long axis of the second connector 132.

The linkage element 136 may be a single connecting bar. In the present embodiment, the linkage element 136 is a U-shape connecting bar. The U-shape connecting bar has a first pivoting end 136*a*, a second pivoting end 136*b* and a bar portion 136*c* connecting the first pivoting end 136*a* and the second pivoting end 136*b*. Please refer to FIG. 2B, the linkage element 136 is inserted into the first pivoting portion 134*c* and the second pivoting portion 135*c* through the first pivoting end 136*a* and the second pivoting end 136*b* respectively, and connects the first base 134 with the second base 135. In other words, the two ends of the linkage element 136 are pivotally positioned on the first extension portion 134*b* and the second extension portion 135*b* through the first gap and the second gap respectively.

Figure 3A:
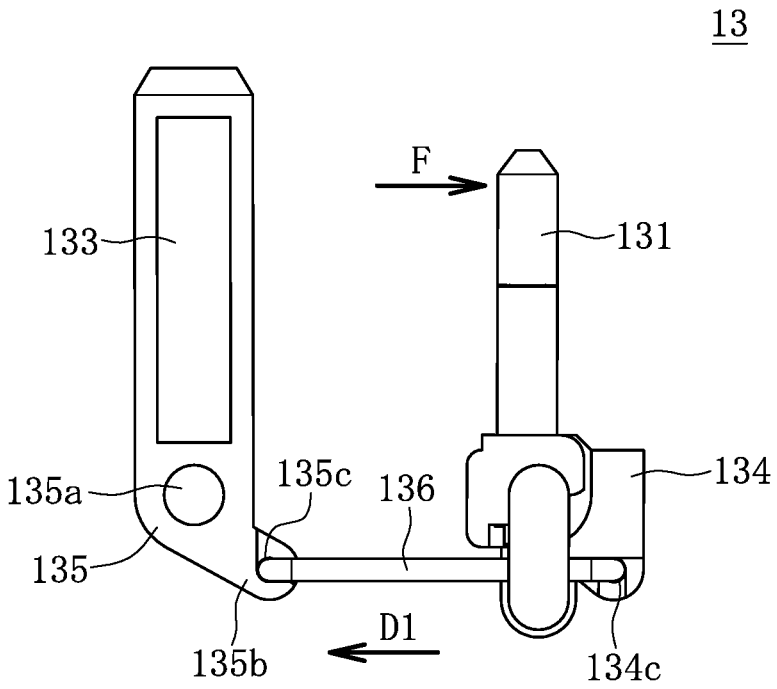
FIGS. 3A and 3B are the side views of the plug component of the embodiment of the instant disclosure under a different status.
Figure 3B:
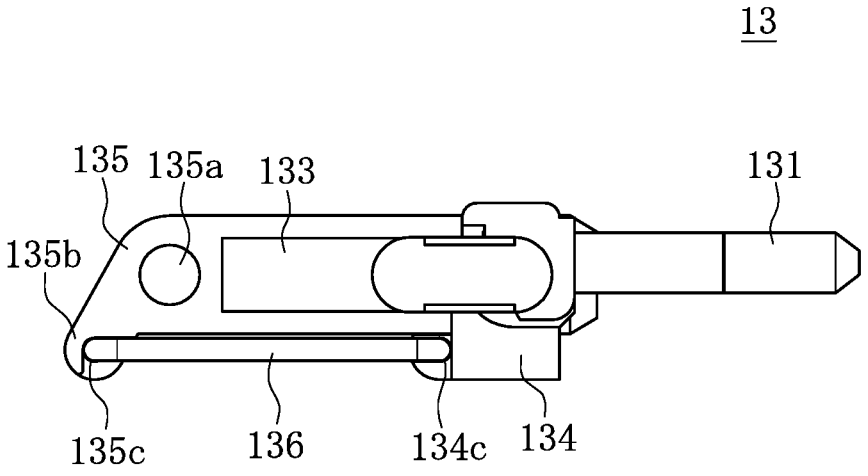

Please refer to FIG. 3A and FIG. 3B. FIG. 3A shows the side view of the plug components of the embodiment of the instant disclosure in use, and FIG. 3B shows the side view of the plug components of the embodiment of the instant disclosure under storage.

Referring to FIG. 3A, in the present embodiment, when a user intends to arrange the first connector 131, the second connector 132 and the third connector 133 in the recesses 110*h*, he may clockwisely apply an external force to the first connector 131, thereby driving the first base 134 to clockwisely rotate relative to the main body. Since the first pivoting portion 134*c* connecting the first base 134 and the linkage element 136 is offset from the first axial portion 134*a* of the first base 134, the first base 134 would drive the linkage element 136 to move along a first direction D1 (the direction shown by the arrow in FIG. 3A) upon rotation.

On the other hand, since the connecting point between the linkage element 136 and the second base 135 is offset from the second axial portion 135*a* of the second base 135, i.e., offset from the axis of the second base 135, when the linkage element 136 moves along the first direction D1, it would apply a torque toward the second base 135 to drive the second base 135 to pivotally rotate relative to the main body 10, thereby driving the third connector 133 rotate clockwise. Therefore, the first connector 131, the second connector 132 and the third connector 133 may rotate toward a same direction to a horizontal position and arrange in the recesses 110*h*. Moreover, the front end of the third connector 133 may be exactly arranged in the slot 134*h* of the first base.

In other words, when the first connector 131, the second connector 132 and the third connector 133 rotate from a vertical position to a horizontal position, the third connector is rotated toward the first connector 131 and the second connector 132.

To the contrary, when a user intends to use the plug components 13, he may apply an external force to the first connector 131 or the second connector 132 to enable the first connector and the connector driving the first base 134 to rotate counterclockwise. When the first base 134 rotates counterclockwise, it drives the linkage element 136 and hence drives the second base 135 to rotate counterclockwise relative to the main body 10, thereby recovering the first connector 131, the second connector 132 and the third connector 133 from the horizontal position back to the vertical position for use.

Figure 4:
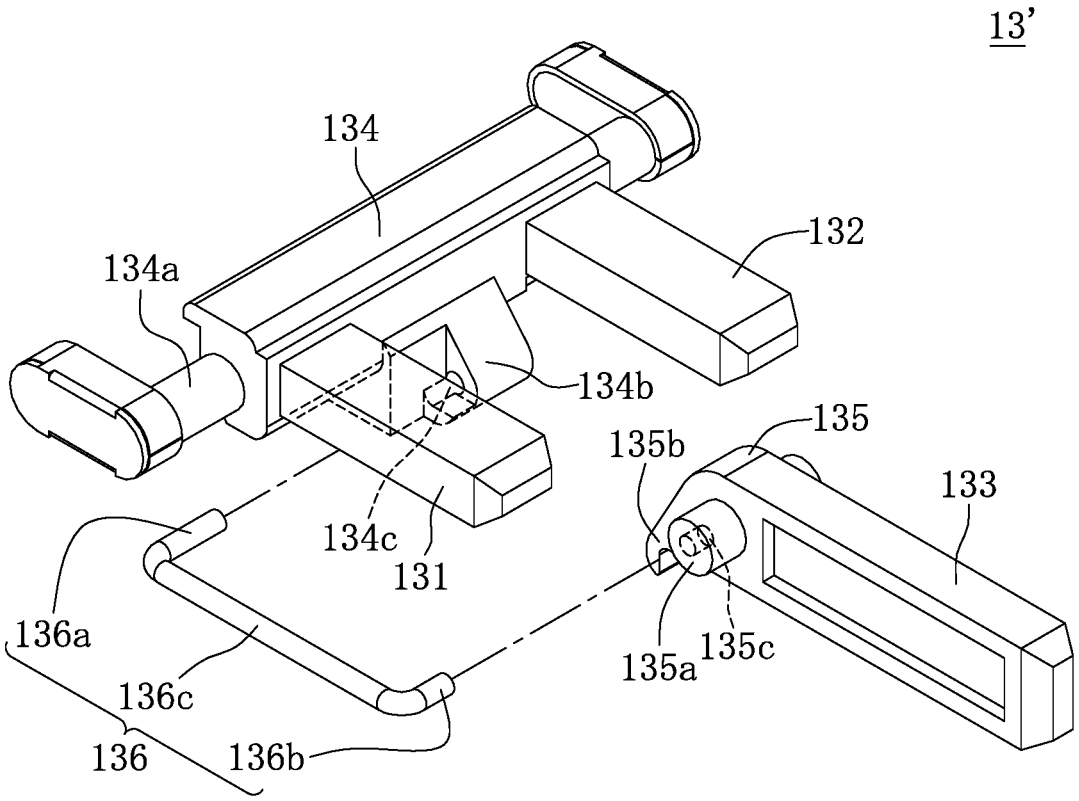
FIG. 4 is a 3-dimentional exploded view of a plug component of another embodiment of the instant disclosure.

Please refer to FIG. 4. FIG. 4 is a 3-dimentional exploded view of the plug components of another embodiment of the instant disclosure. The specification of the plug component 13' of the present embodiment is the same as that of the previous embodiment and hence, will not be described in detail. In addition, the same element has the same symbol. Furthermore, the moving process of the plug components 13' of the present embodiment is the same as the moving process of the FIGS. 3A and 3B, and will not be described in detail.

The difference between the present embodiment and the previous embodiment resides in that in the present embodiment, when the first connector 131, the second connector 132 and the third connector 133 rotate from the vertical position to the horizontal position, the first connector 131 and the second connector 132 are rotated toward the third connector 133 to horizontally arrange in the recesses 110*h*. In other words, in the present embodiment, the rotation directions of first connector 131, the second connector 132 and the first connector 133 are opposite to that of the previous embodiment.

Therefore, parts of the structure of the first base 134 and the second base 135 are different from the previous embodiment. For example, since the third connector 133 will not interfere with the first base 134 under the horizontal status, the first base 134 does not need to have the slot 134*h* as in the previous embodiment.

In addition, the extension direction of the second extension portion 135*b* of the second base 135 is different from that of the previous embodiment. In the present embodiment, when the first connector 131, the second connector 132 and the third connector 133 rotate to the horizontal position, the second extension portion 135*b* of the second base 135 is extended toward the first base 134.

To be specific, the second extension portion 135*b* of the second base 135 extends to a position between the first connector 131 and the second connector 132, and inclines downwardly to a position below the horizontal position of the first connector 131 and the second connector 132. Therefore, when the first connector 131, the second connector 132 and the third connector 133 rotate to the horizontal position, seen from the top, the linkage element 136 will not be directly under the third connector 133, and will be between the first connector 131 and the second connector 132.

Furthermore, the structure of the first base 134, the second base 135 and the linkage element 136 may be used in the other plug components with different specifications achieving the same effect. The effect of the instant disclosure may be achieved as long as the pivot position between the linkage element 136 and the first base 134 and the pivot position between the linkage element 136 and the second base 134 are offset from the first axial portion 134*a* and the second axial portion 135*a* respectively. Therefore, the structure of the first base 134, the second base 135 and the linkage element 136 may have other modifications.

Figure 5:
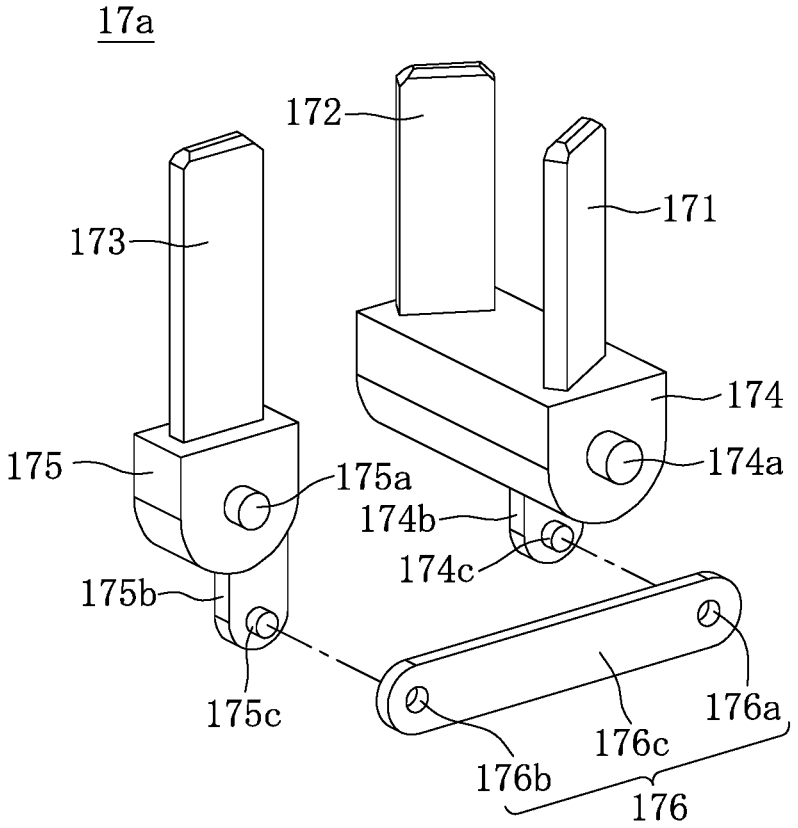
FIG. 5 is a 3-dimentional view of the plug component of another embodiment of the instant disclosure.

Please refer to FIG. 5. FIG. 5 is a 3-dimentional view of a plug component of another embodiment of the instant disclosure. In the present embodiment, the specification of the plug components 17*a* is different from the previous embodiment and hence, the shapes and arrangements of the first connector 171, the second connector 172 and the third connector 173 are different from the previous embodiment.

Furthermore, different from the previous embodiment, the first pivoting portion 174*c* and the second pivoting portion 175*c* on the first extension portion 174*b* and the second extension portion 175*b* are both a concave boss in the present embodiment. The linkage element 176 is a linear connecting rod, and the two ends of the linear connecting rod have through holes 176*a*, 176*b* for accommodating the first pivoting portion 174*c* and the second pivoting portion 175*c*. In other words, the linkage element 176 is pivotally connected to the first extension portion 174*b* and the second extension portion 175*b* through the through holes 176*a*, 176*b*.

Figure 6:
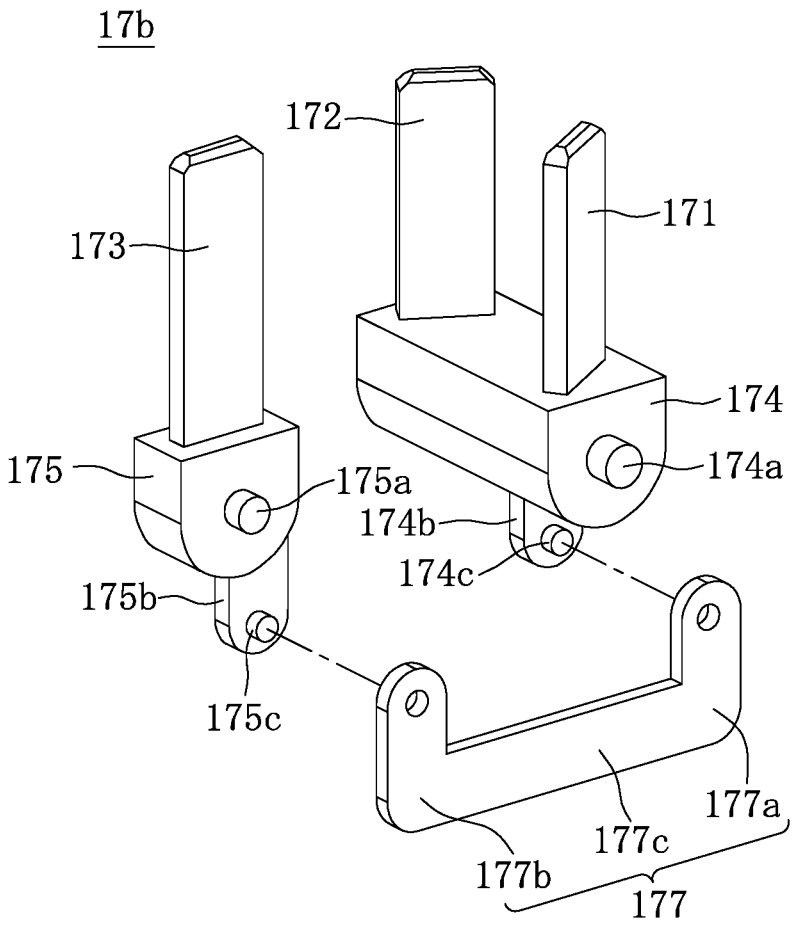
FIG. 6 is a 3-dimentional view of a plug component of yet another embodiment of the instant disclosure.

Please refer to FIG. 6. FIG. 6 is a 3-dimentional view of the plug component of yet another embodiment of the instant disclosure. The plug component 17*b* of the present embodiment has a similar structure to the plug component of FIG. 5 and hence, the same parts are not described in detail herein and the same elements have the same symbol. Different from the embodiment of FIG. 5, the linkage element 177 is a U-shape connecting rod in FIG. 6. The first pivoting end 177*a* and the second pivoting end 177*b* of the U-shape connecting rod both have through holes for accommodating to the first pivoting portion 174*c* and the second pivoting portion 175*c*. In addition, when the first connector 171, the second connector 172 and the third connector 173 rotate from the horizontal status to the vertical status, the direction of the through holes of the U-shape connecting rod is the same as the extension direction of the first connector 171, the second connector 172 and the third connector 173, i.e., upward.

In an embodiment, if the third connector 173 is rotated to the horizontal status toward the first connector 171 and the second connector 172, the second base 175 may be rotated to a position between the first pivoting end 177*a* and the second pivoting end 177*b* of the U-shape connecting rod. In another embodiment, if the first connector 171 and the second connector 172 are rotated to the horizontal status toward the third connector 173, the first base 174 will rotate to a position between the first pivoting end 177*a* and the second pivoting end 177*b* of the U-shape connecting rod.

Figure 7A:
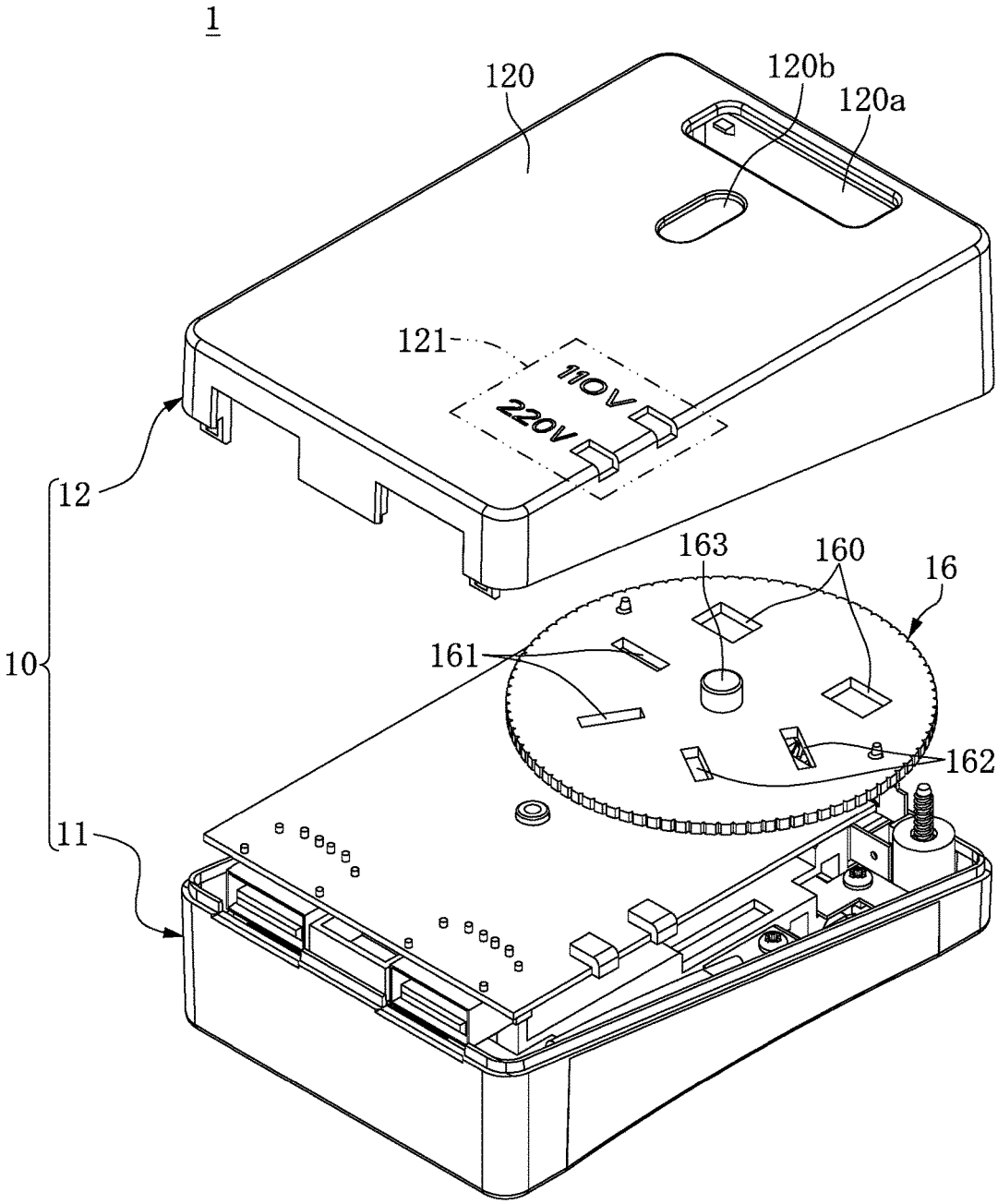
FIG. 7A is the 3-dimentional exploded view of the multi-function charger of FIG. 1A under another view point.
Figure 7B:
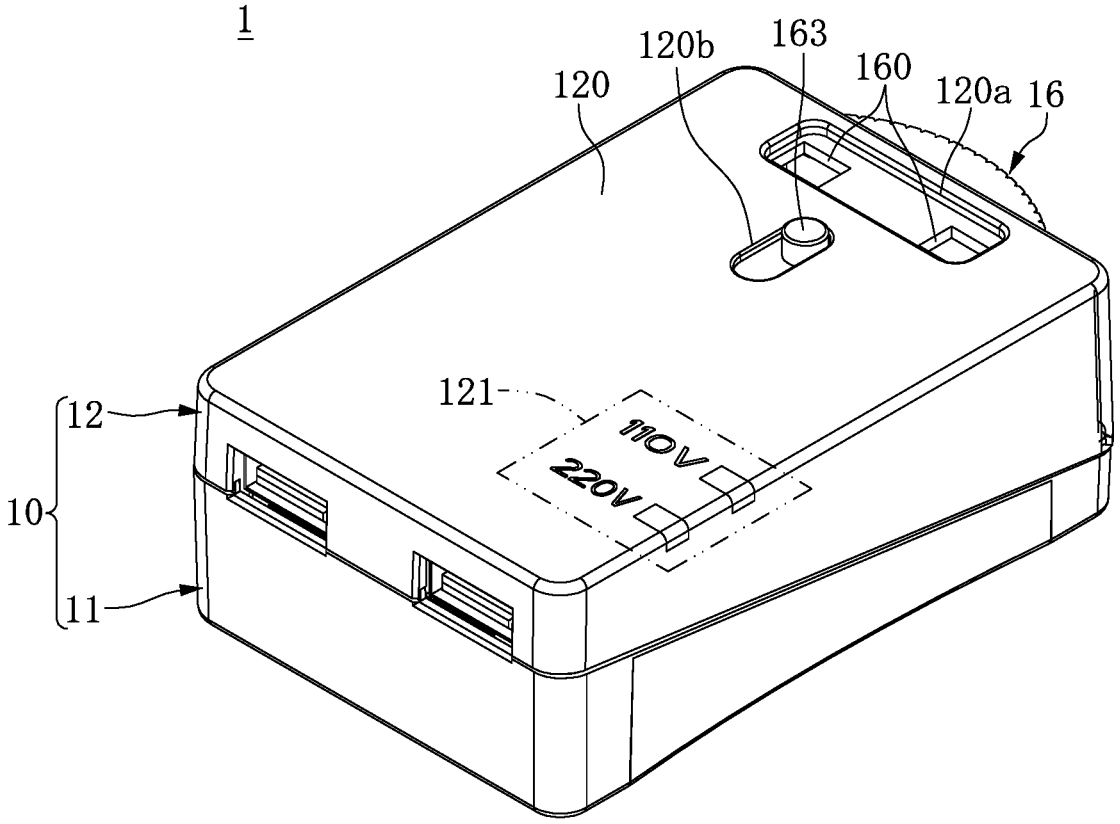
FIG. 7B is the 3-dimentional view of the multi-function charger of FIG. 1A under another view point.

Please refer to FIG. 7A and FIG. 7B. FIG. 7A is the 3-dimentional exploded view of the multi-function charger under another view point. FIG. 7B is the 3-dimentional view of the multi-function charger under another view point. As shown in FIG. 7A and FIG. 7B, the second surface 120 of the second casing 12 has a socket region 120*a* and a chute

120*b*, and the main body 10 has a socket slot selecting member 16 and a pushing button 163, wherein the socket slot selecting member 16 may expose the second surface 120 through the socket region 120*a*, and the pushing button 163 may interlink with the socket slot selecting member 16 and protrude from the second surface 20 through the chute 120*b*.

In the present embodiment, the socket slot selecting member 16 is a rotation plate and has a plurality of sets of socket slots 160~162 positioned around the center of the rotation plate. In addition, the second casing 12 has an opening on the surface adjacent to the second surface 120 to enable a part of the rotation plate to protrude from the main body 10 through the opening.

In sum, when the user moves the pushing button 163 along the chute 120*b*, the rotation plate will move to expose one set of the plurality of sets of socket slots 160~162 on the socket region 120*a*, thereby protruding a part of the rotation plate from the main body 10 through the opening. In the meantime, the user may rotate the part of the rotation plate that protrudes from the main body 10 to select the set of the socket slot 160 that he intends to use.

Furthermore, please refer to FIG. 7A. The multi-function charger 1 of the present embodiment further comprises a voltage display interface 121 on the second surface 120. Furthermore, the multi-function charger 1 displays the corresponding voltage value on the voltage display interface 121 based on the power received by the socket components 13~15. In the present embodiment, the voltage display interface 121 shows the voltage value through the numbers on the second surface 120 and an indication light positioned inside of the main body 10. In other embodiments, the voltage display interface 121 may be a display panel or other element.

Figure 8:
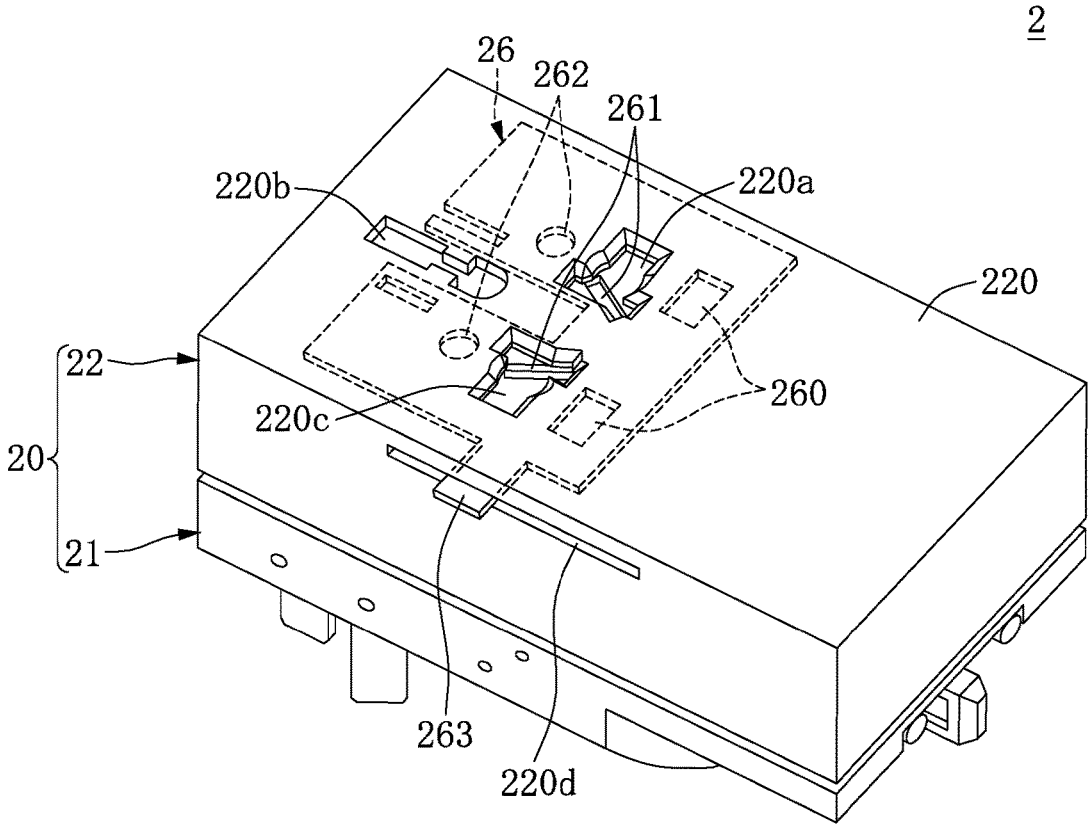
FIG. 8 is the 3-dimentional view of a multi-function charger of another embodiment of the instant disclosure.

Please refer to FIG. 8. FIG. 8 is a 3-dimentional view of the multi-function charger of another embodiment of the instant disclosure. Different from the previous embodiment, the second surface 220 of the multi-function charger 2 has three slots 220*a*~220*c*, and the surface adjacent to the second surface 220 has a chute 220*d* in the present embodiment. Furthermore, the socket slot selecting member 26 has a plurality of sets of socket slots 260~262 positioned side by side and the positions of these socket slots 260~262 are corresponding to the position of the slots 220*a*~220*c* on the second surface 220. In addition, the diameters of the slot 220*a*~220*c* are larger than each set of the socket slots 260~262 to ensure each set of the socket slot 260~262 can be exposed from the slots 220*a*~220*c*.

The socket slot selecting member 26 of the present embodiment has a protruding portion 263 that may protrude from the main body 20 through the chute 220*d*. The user may control the movement of the protruding portion 263 to expose different sets of the socket slots 260~262 from the slots 220*a*~220*c* based on need, in order to select a suitable socket slot 260~262.

The above-mentioned descriptions represent merely the exemplary embodiments of the instant disclosure, without any intention to limit the scope of the instant disclosure thereto. Various equivalent changes, alterations or modifications based on the claims of present disclosure are all consequently viewed as being embraced by the scope of the instant disclosure.

What is claimed is:

1. A multi-function charger, comprising:

a main body having a first surface and a second surface opposite to the first surface, the first surface having a recess;

a first plug arranged on the first surface, the first plug has a first connector, a second connector and a third connector;

a first base connected to the first connector and the second connector;

a second base connected to the third connector; and a linkage element pivotally connected to the first base and the second base for enabling the first connector, the second connector and the third connector to rotate in a same direction to be arranged in the recess, wherein the linkage element is located in a connecting region defined between a central section of the first base and the second base.

2. The multi-function charger according to claim 1, wherein the third connector rotates toward the first connector and the second connector to be horizontally arranged in the recess.

3. The multi-function charger according to claim 2, wherein the linking element is a U-shape connecting rod, the U-shape connecting rod has a first pivoting end, a second pivoting end and a rod portion connecting the first pivoting end and the second pivoting end, when the first connector, the second connector and the third connector are arranged in the recess, the rod portion is located under the third connector.

4. The multi-function charger according to claim 2, wherein the first base has an opening between the first connector and the second connector for arranging a front end of the third connector.

5. The multi-function charger according to claim 2, wherein the first base has a first axial portion and a first extension portion, the second base has a second axial portion and a second extension portion opposite to the third connector, the two ends of the linkage element are pivotally positioned on the first extension portion and the second extension portion respectively, when the first connector, the second connector and the third connector are arranged in the recess, the second extension portion extends toward a direction opposite to the first base.

6. The multi-function charger according to claim 5, wherein the first extension portion has a first gap, the second extension portion has a second gap, and the linkage element is pivotally positioned on the first extension portion via the first gap and pivotally positioned on the second extension portion via the second gap.

7. The multi-function charger according to claim 1, wherein the second surface has a socket region located therein, the main body has a rotation plate and a pushing button located therein, and the rotation plate and the pushing button are interlinked to expose one of a plurality set of socket slots through the socket region.

8. The multi-function charger according to claim 1, wherein the second surface has a voltage display interface, and the multi-function charger displays the corresponded voltage value on the voltage display interface based on a power received by the first plug.

9. The multi-function charger according to claim 1, wherein the first connector and the second connector rotate toward the third connector to be horizontally arranged in the recess.

10. The multi-function charger according to claim 9, wherein the first base has a first axial portion and a first extension portion, the second base has a second base and a second extension portion opposite to the third connector, the two ends of the linkage element are pivotally positioned on the first extension portion and the second extension portion respectively, and when the first connector, the second connector and the third connector are arranged in the recess, the second extension portion extends toward a direction opposite to the first base.

* * * * *